US005448800A

United States Patent [19]

Faas et al.

[11] Patent Number: 5,448,800

[45] Date of Patent: Sep. 12, 1995

[54] TRASH EXTRACTOR FOR SEPARATING IMPURITIES FROM A TRAVELING FLEECE

[75] Inventors: Jurg Faas, Dinhard; Robert Demuth, Nurensdorf, both of Switzerland

[73] Assignee: Rieter Machine Works, Winterthur, Switzerland

[21] Appl. No.: 150,154

[22] PCT Filed: Mar. 23, 1993

[86] PCT No.: PCT/CH93/00079

§ 371 Date: Dec. 29, 1993

§ 102(e) Date: Dec. 29, 1993

[87] PCT Pub. No.: WO93/19232

PCT Pub. Date: Sep. 30, 1993

[30] Foreign Application Priority Data

Mar. 25, 1992 [CH] Switzerland ..... 00947/92

[51] Int. Cl.[6] ..... D01G 9/06; D01G 15/34

[52] U.S. Cl. ..... 19/108; 19/113; 19/114

[58] Field of Search ..... 19/98, 107, 113, 114, 19/108, 96

[56] References Cited

U.S. PATENT DOCUMENTS

| | | | |
|---|---|---|---|
| 3,936,911 | 2/1976 | Roberts | 19/113 |
| 4,014,076 | 3/1977 | Slanik | 19/96 |
| 4,553,288 | 11/1985 | Schneider et al. | 19/114 X |
| 4,651,387 | 3/1987 | Giuliani | 19/114 X |
| 4,683,152 | 3/1987 | Wada | 19/114 |
| 5,031,278 | 7/1991 | Demuth et al. | 19/98 |
| 5,228,170 | 7/1993 | Giuliani | 19/113 X |
| 5,247,721 | 9/1993 | Demuth et al. | 19/107 X |

FOREIGN PATENT DOCUMENTS

| | | |
|---|---|---|
| 0436754 | 7/1991 | European Pat. Off. . |
| 0103014 | 1/1917 | United Kingdom . |
| 0703376 | 2/1954 | United Kingdom . |
| 1337694 | 11/1973 | United Kingdom . |

*Primary Examiner*—Clifford D. Crowder
*Assistant Examiner*—John J. Calvert
*Attorney, Agent, or Firm*—McAulay Fisher Nissen Goldberg & Kiel

[57] ABSTRACT

The separation of impurities through an opening in the casing of a rotating roller or drum is increased by guide grooves or guide gaps in the casing. The guide grooves or guide gaps extend in the direction of movement of the conveyed fibers and open out into the separating opening. The guide grooves may be formed directly in the casing in the surface facing the rotating roller or drum or may be formed by separate elements which are mounted on the casing and extend into the separating opening.

19 Claims, 9 Drawing Sheets

TRASH EXTRACTOR FOR SEPARATING IMPURITIES FROM A TRAVELING FLEECE

The invention relates to an apparatus for separating impurities and/or fiber fragments and short fibers ("trash") from the fiber material which is guided along a curved path, in form of a fleece, about the axis of rotation of a roller or a drum, for example. The path is limited by an external casing comprising at least one opening being provided in the casing through which the impurities and/or trash are to be separated.

STATE OF THE ART

Separating apparatuses of the kind mentioned above are known in many places in the blowroom of a fiber-processing plant, and also in many places in a spinning mill. Examples of these are found in the following publications of prior art:

| Country | No. | Owner | Type of application |
|---|---|---|---|
| EP | 23 597 | Trutzschler | On a rotating roller |
| EP | 110 017 | Rieter | On a rotating roller |
| EP | 250 126 | Carding Spec. | On the swift of a card |
| DE | 33 36 323 | Trutzschler | On the swift of a card |
| us | 5 022 121 | Hollingsworth | On the swift of a card |
| DE | 38 25 419 | Trutzschler | On the licker-in of a card |
| DE | 39 02 202 | Trutzschler | On the swift of a card or (FIG. 9) on the licker-in |
| DE | 39 02 204 | Trutzschler | On a rotating roller |
| DE | 40 18 311 | Trutzschler | On a rotating roller |
| US | 4 009 562 | Rieter | Opening cylinder of a rotor spinning machine |
| US | 4 972 352 | Graf | On the swift of a card |
| DE | 30 34 036 | Hollingsworth | On the swift of a card |
| DE | 38 21 771 | Jacobsen | On the swift of a card |

In EP 388 791 (or U.S. Pat. No. 5,031,278) it has now been proposed to provide the casing "upstream" of the opening with a structured surface which is used, in particular, to make the fleece oscillate so as to use the centrifugal force, which also acts on the impurities in the fleece, to convey the impurities more easily to the surface in order to separate them on the edge of a knife and to carry them off by means of a suction device. The structure on the surface may be provided, for example, in the form of a clothing segment. It may also, however, be provided in fish scale-like or by knurlings or longitudinal grooves or longitudinal shafts. The longitudinal grooves or longitudinal shafts extend in the axial direction of the rotating roller, i.e., transversal to the direction of movement of the fleece.

THE INVENTION

The above-mentioned arrangement with the clothing segment has proved to be exceptionally effective. On the basis of a new explanation of the effect of this arrangement it is now the object of the present invention to propose arrangements derived therefrom which can be used, in particular, where clothing segments are undesirable (for reasons pertaining to costs, maintenance or technology).

The invention provides an apparatus for separating impurities and/or trash from fiber material which is guided in the form of a fleece by suitable means along a curved path, e.g., about the axis of rotation of a rotating roller or drum. The path of movement is limited externally by a casing, i.e., the outer mantle surface of the path is limited by the inner surface of the casing. The casing is provided with at least one opening, through which impurities and/or trash can be separated. That is, the casing extends to an opening adjacent one edge of the casing for passage of the impurities run off from a conveyed fiber fleece under centrifugal force.

In accordance with the invention, the casing is provided with at least one guide groove or guide opening extending in the direction of movement of the fleece and opening out into the separating opening to convey impurities thrown off form the conveyed fleece into the separating opening.

Usually, the longitudinal separating opening extends transversal to the direction of movement of the fleece and a plurality of guide grooves or guide openings are provided which are arranged parallel to one another.

Between the grooves or openings the casing continues to provide the fiber fleece with an inwardly directed guide surface which counteracts the escaping of the fibers under the influence of centrifugal force. The guide grooves or guide openings can, however, receive the dirt particles and/or the trash. The arrangement acts selectively in various manners on fiber material and/or impure material and is favourable to the separation of impurities and/or trash materials, which is highly favourable for the separation of impurities and trash in the further conveyance of batch fibers. "Batch fibers" shall be understood herein as being "desirable fibers". This means that the system should be adaptable to the requirements of the respective application.

In another embodiment, instead of providing grooves in the casing, means may be provided on the casing to define at least one gap facing the fleece conveying means and extending from the edge of the casing into the separating opening in order to convey impurities through from the conveyed fleece into the separating opening. This means may be in the form of an element having a plurality of spaced part teeth or parallel projecting fingers for defining the gaps therebetween. In still another embodiment, the means may be in the form of an element having projecting pins or a plurality of grooves which define gaps. In still another embodiment, the means mounted on the casing may be in the form of a pair of elements which define the gaps with the elements being movable relative to each other transversely of the gaps in order to adjust the width of the gaps.

As noted above, the means for conveying the fleece may be one of a licker-in, a cleaning roller and an opening roller.

These and other objects and advantages of the invention will become more apparent from the following detailed description taken in conjunction with the accompanying drawings wherein:

FIG. 1 schematically shows a card;

FIG. 2 schematically shows the licker-in of a card;

FIG. 3 schematically shows the opening roller or a cleaning roller;

FIG. 4 shows an arrangement in accordance with the state of the art for application in a card or an opening or cleaning machine;

FIG. 4*a* shows a detail of the arrangement in accordance with FIG. 4;

FIG. 7 shows an adjustable arrangement, in particular for application in a licker-in;

FIG. 8 shows a further adjustable variation, in particular for application in a licker-in;

Figure 11:
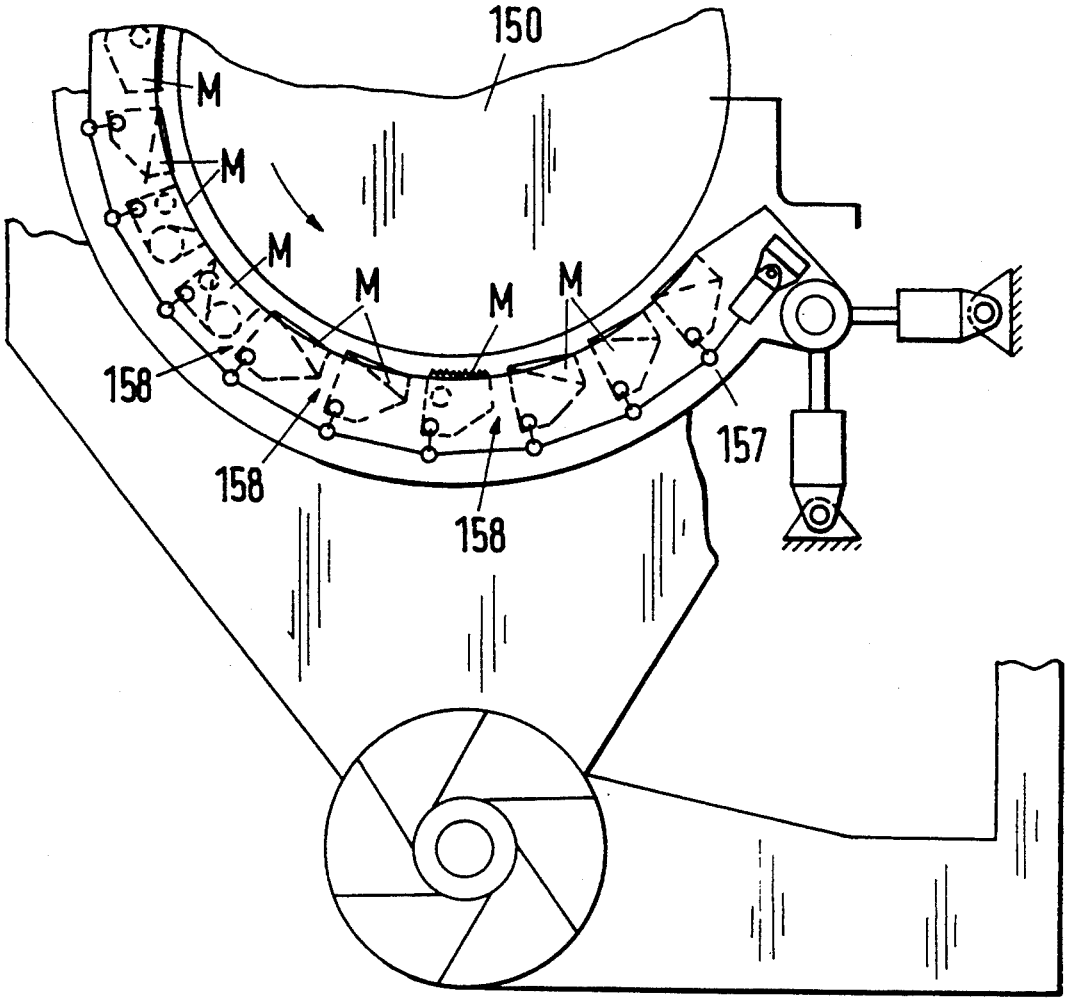
Figure 12:
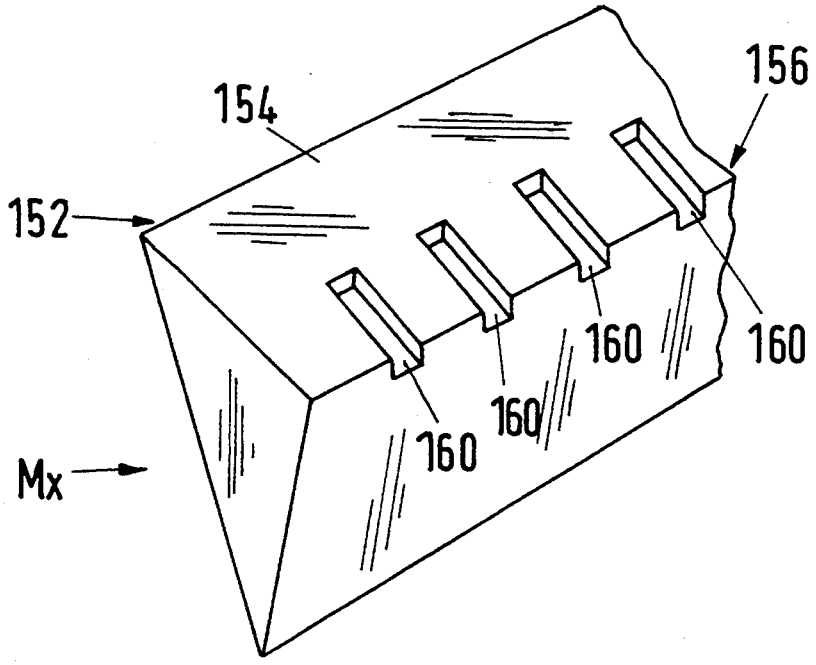
Figure 13:
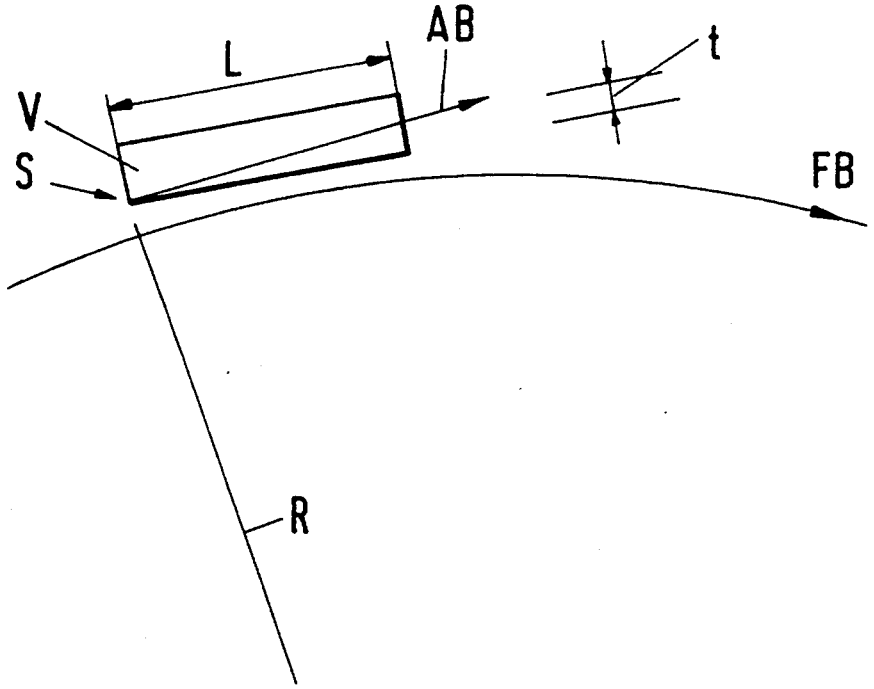

FIG. 11 schematically shows a grid arrangement in accordance with European patent application No. 91 116 934.0;

FIG. 12 shows a modification in accordance with this invention of the grid rods in accordance with EP 91 116 934.0;

FIG. 13 shows a diagram for explaining the "geometry of the arrangement".

Figure 1:
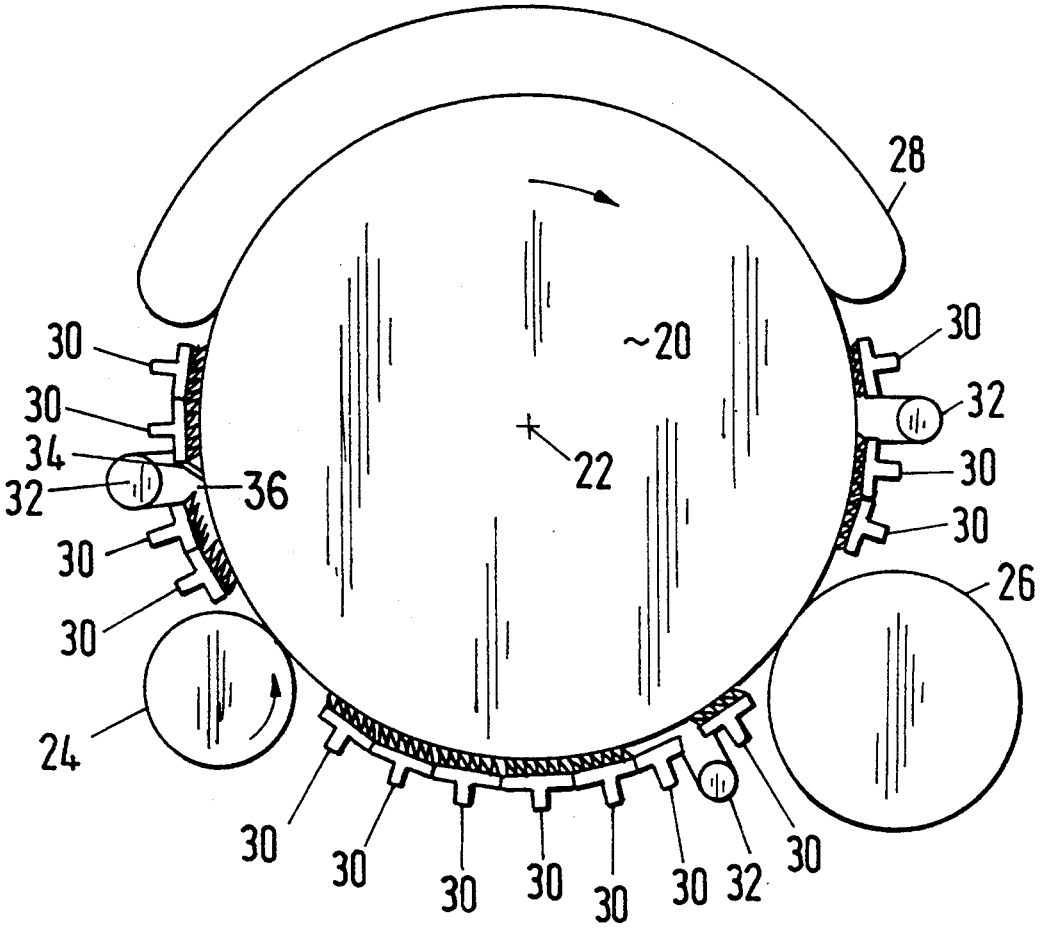

FIG. 1 shows a card as is shown in FIG. 1 of EP-A-388 791 (or U.S. Pat. No. 5,031,278). The card comprises a swift 20 which is rotatably held about axle 22. A licker-in 24 and a doffing cylinder 26 cooperate with the swift. The swift 20 also cooperates with a revolving flat arrangement 28 over a part of its circumference.

Between the licker-in 24 and the revolving flat arrangement 28 (in the "breaker card zone") there are provided five casing elements 30, 32, of which four elements 30 each offer the swift 20 a guide surface which is provided with clothing elements 34. The fifth element 32 overlaps an opening 36 between two elements 30 and changes the opening 36 into a suction device when element 32 is connected to a source with pressure below atmospheric (not shown). The (longitudinal) opening 36 extends over the whole working width of swift 20.

Between the revolving flat arrangement 28 and the doffing cylinder 26 (in the "post-carding zone") there are three further elements 30 and a further element 32. Between the doffing cylinder 26 and the licker-in 24 ("lower carding zone") there are seven elements 30 and a further element 32. The effects of the various swift casing elements are explained below in greater detail by reference to FIG. 4.

Figure 2:
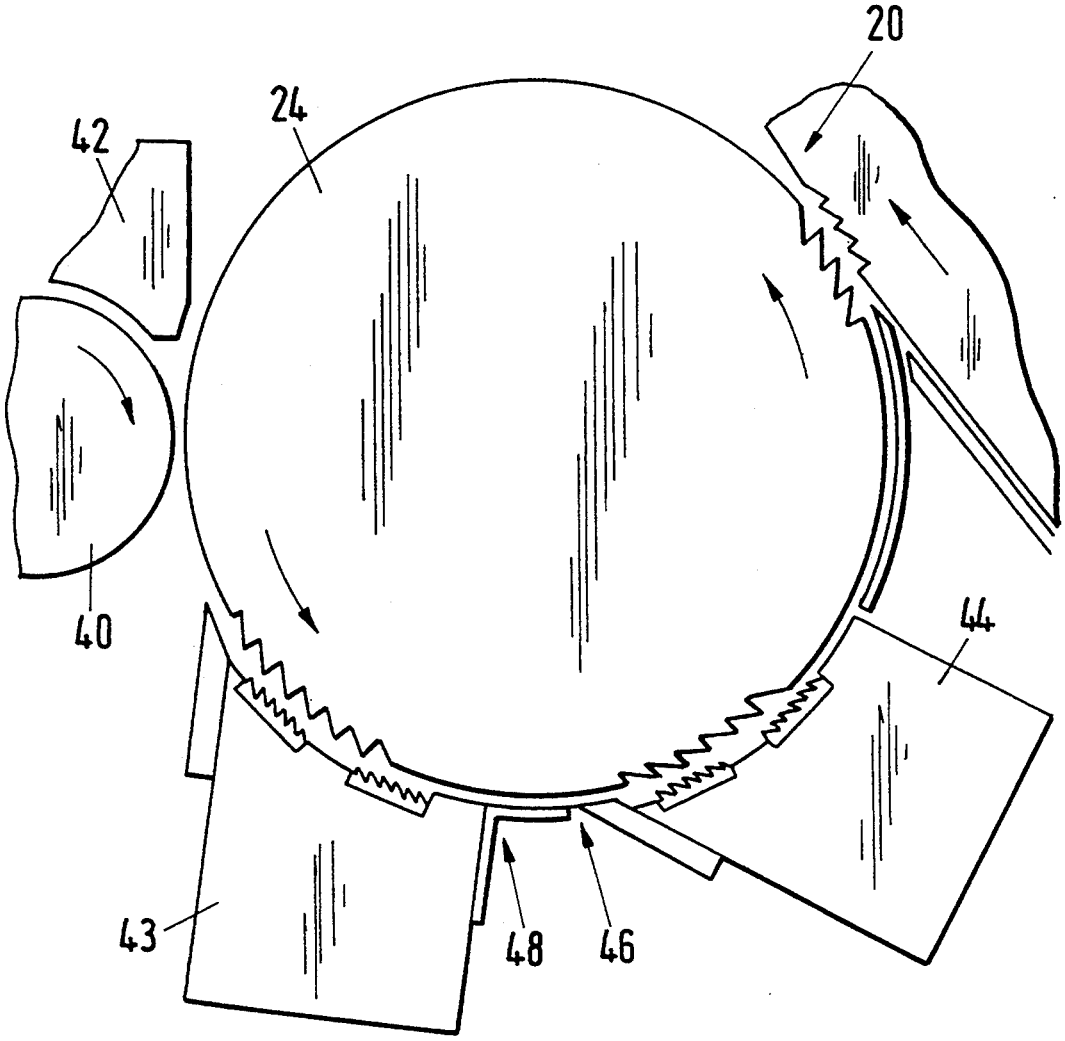

FIG. 2 shows the licker-in 24 with further devices with which it cooperates, i.e., a feed cylinder 40 with a feed table 42 and two trimmed casing elements 43, 44. Between the latter elements 43, 44 there is situated an opening 46 which extends over the whole working width of the machine (like opening 36). The directions of rotation of the various rollers and drums are shown in FIGS. 1 and 2 by arrows. In this case, no further element is provided for converting opening 46 into a suction device.

Upstream of the opening 46 (relative to the direction of rotation of the licker-in 24), element 43 carries a guide element 48 which is L-shaped in cross section and which is provided with a carrier leg attached to element 43 and a guide leg which extends from element 43 in the direction of element 44.

Figure 3:
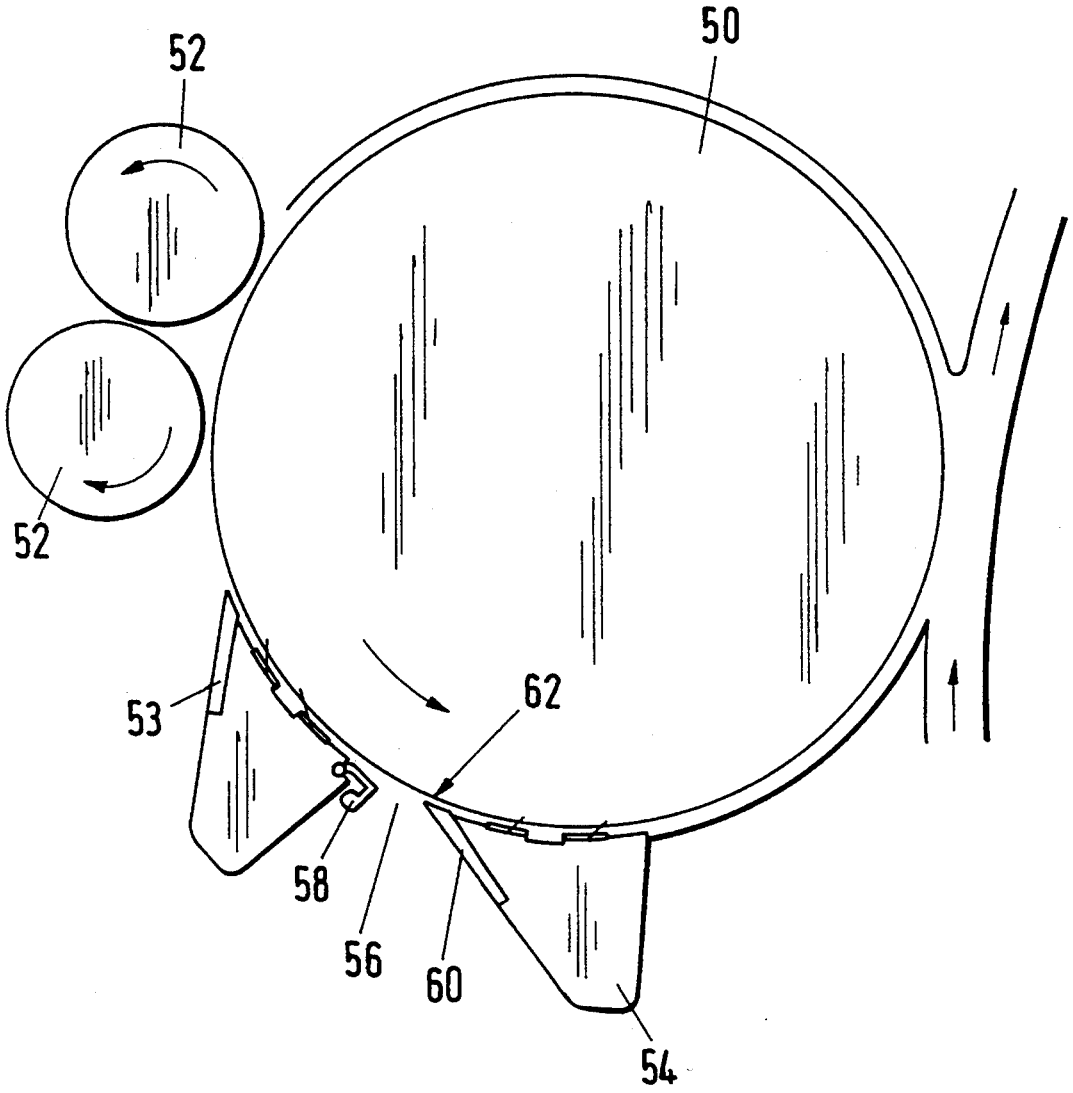

FIG. 3 shows a trimmed roller 50 of a cleaning machine, e.g., according to DOS 3 902 204 or DOS 4 018 311. The fiber material to be cleaned (not shown) is supplied to roller 50 through a pair of feed rollers 52. The fiber material is guided past guide plates (casing plates) 53, 54, with an opening 56 being formed between the two adjacent plates 53, 54. Opening 56 can be converted by a source with pressure below atmospheric (not shown) into a suction device.

The guide plate 53 carries a guide element 58 and the guide plate 54 carries a knife 60 which offers the roller 50 a separating edge 62.

Figure 4:
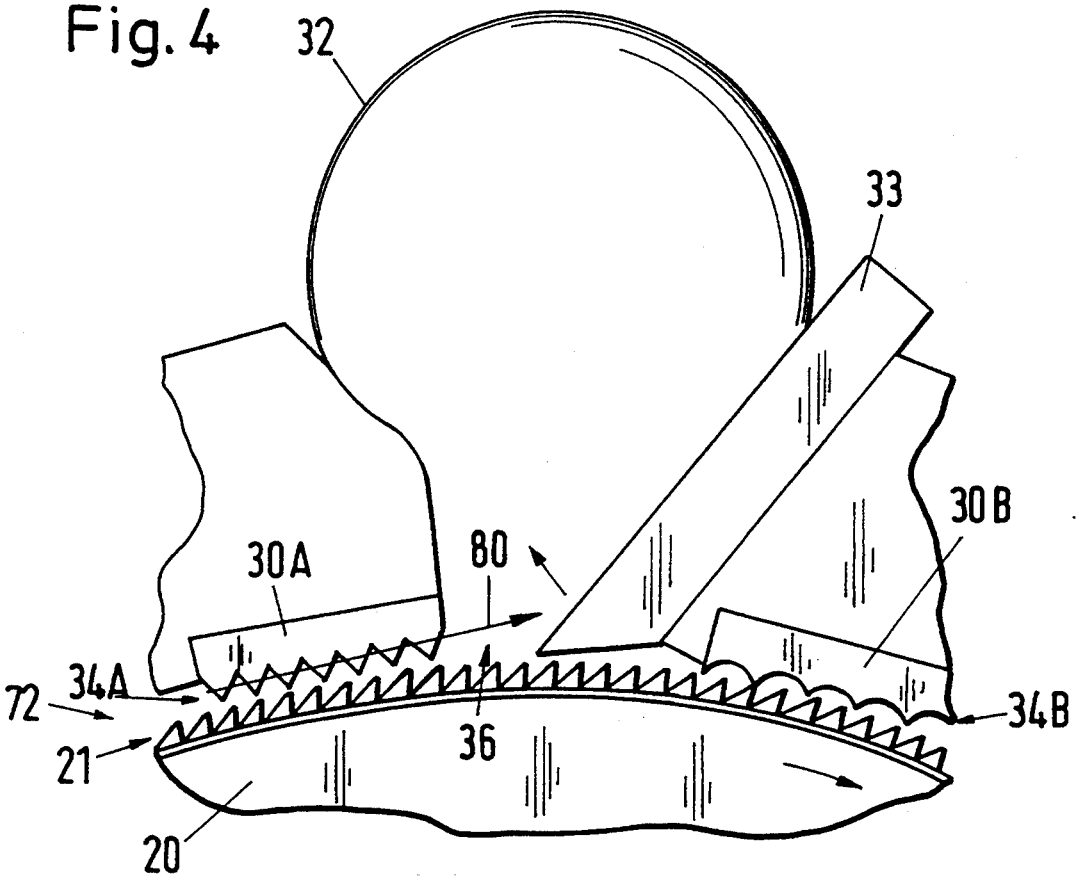

FIG. 4 shows a detail of the arrangement in accordance with FIG. 1 (i.e., in accordance with EP 388 791). The swift 20 carries a clothing 21. The clothing of the casing element 30A "upstream" of the opening 36 is indicated with reference numeral 34A and the clothing of casing element 30B "downstream" of opening 36 is indicated with the reference numeral 34B.

Figure 4A:
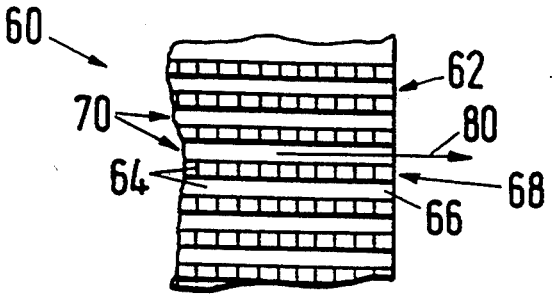

The latter clothing 34B is not of particular importance herein and shall not be explained in greater detail. Clothing 34A, however, plays an important role and shall be explained below in greater detail on the basis of a special representation of a section 60 (FIG. 4A). For the representation in FIG. 4A, the element 30A is viewed in the radial direction outwardly from swift 20. The edge 62 in FIG. 4A is the "front" edge of element 30A and limits the opening 36. The opposite edge of element 30B (FIG. 4) carries a separating knife 33, which is well known from the state of the art.

Clothing 34A (as well as clothing 21) consists of wire elements 64 (FIG. 4A) situated adjacent to one another, with every wire element 64 comprising a base element 66 and teeth 68. The base element 66 is slightly wider than teeth 68, so that "alleys" 70 are formed between the rows of teeth 68.

The effect of the known arrangement (known from EP 388 791) in accordance with FIGS. 4 and 4A can be explained as follows:

The space 72 (FIG. 4) between the swift 20 and the casing element 30 forms a "guiding path" for the fiber material entrained by the swift. In this path the fiber material is processed by the clothings 21. The fibers are mainly distributed over the working surface of the swift. However, they are subject to centrifugal forces due to the rotation of the swift. When a fiber (a longitudinal object) tends to move radially outwardly, it is pressed back into clothing 21 through clothing 34A. A fiber will only manage to penetrate "alley" 70 (FIG. 4A) in the following two cases:

I. The fiber is stretched in the direction of movement and is biased outwardly in its entirety through the centrifugal force. This is a more or less rare event.

II. The fiber is very short and therefore fits into the "alley" 70 (fiber fragment, short fibers).

The situation for dirt particles, however, is quite different due to its different form. Under the influence of the centrifugal force such a particle, provided that it is not prevented by the fibers, reaches an "alley" 70 very easily. The dirt particle then follows a flight path, for example, which is indicated by arrow 80. The particle impinges on knife 33, namely a surface thereof which is averted from swift 20. During the rebound the flight path of the particle tends to move more towards the suction device than back to swift 20. A fiber can be "switched off" by knife 33 from the fleece conveyed by swift 20 in the event that the fiber head projects radially outwardly when the fiber is guided below the knife 33. As was indicated above, clothing 34A is mostly used for pressing the fibers back into clothing 21, which reduces the loss-of batch fibers in the suction device.

All told it can be said that clothing 34A makes the separating process on knife 33 more selective, so that mostly impurities, fiber fragments and short fibers are separated.

It is also possible to use this effect without clothings. The processing of fibers is of major interest which have not reached the degree of opening of the fiber fleece on the card swift, e.g., on a cleaning roller 50 (FIG. 3) or on the licker-in 24 (FIG. 2).

Figure 5:
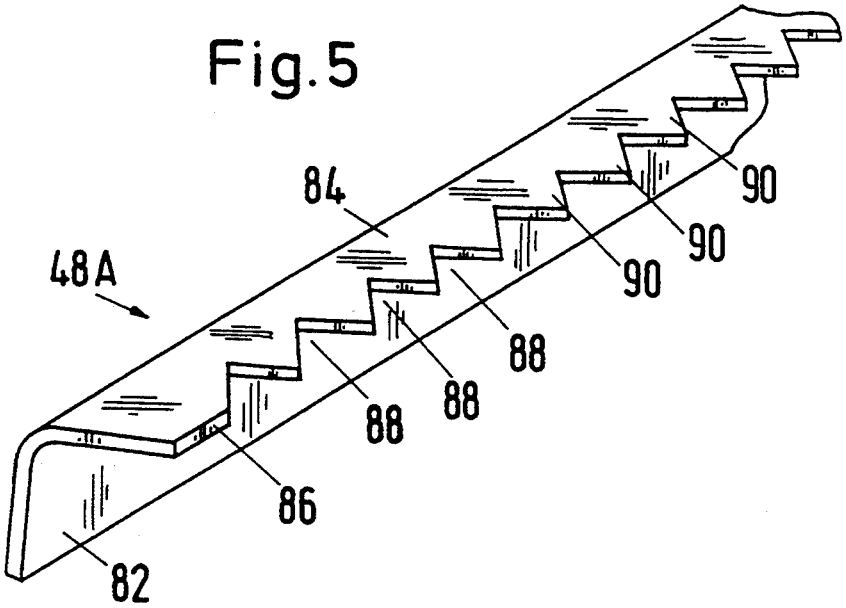
FIG. 5 shows a first variation according to the invention.

FIG. 5 shows a guide plate 48A which can be used as a substitute for the known guide plate 48 on licker-in 24 (FIG. 2). The carrier leg 82 is unchanged and shall not be explained in greater detail. The guide leg 84, however, is provided on its free (front) edge 86 with notches (gaps) 88 which form interposed teeth 90. The notches 88 now pave the way for released dirt particles from the fiber guiding path. The fiber mass, however, is still guided by the teeth 90 along the guiding path. As the fiber mass has not yet been dissolved into single fibers and the single fibers are still more in a randomly laid layer, there are only limited possibilities for the individual fibers to escape through notches 88, particlarly when no suction effect is exercised.

Figure 6A:
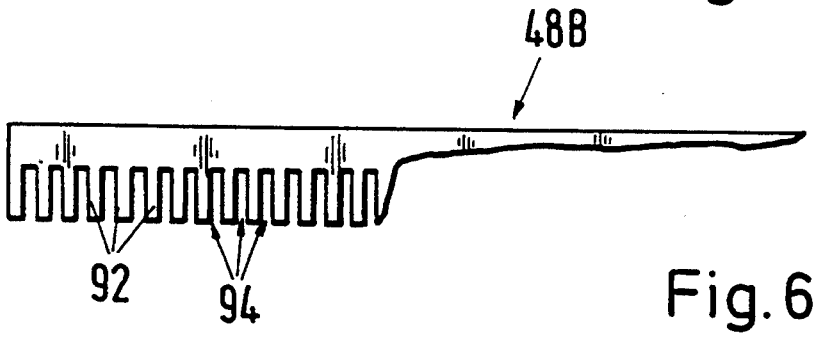
FIG. 6 shows in A, B and C further possible variations.
Figure 6B:
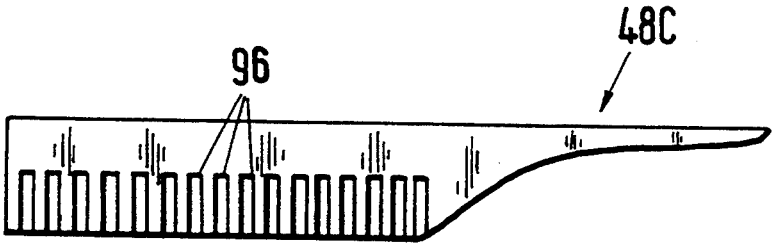
Figure 6C:
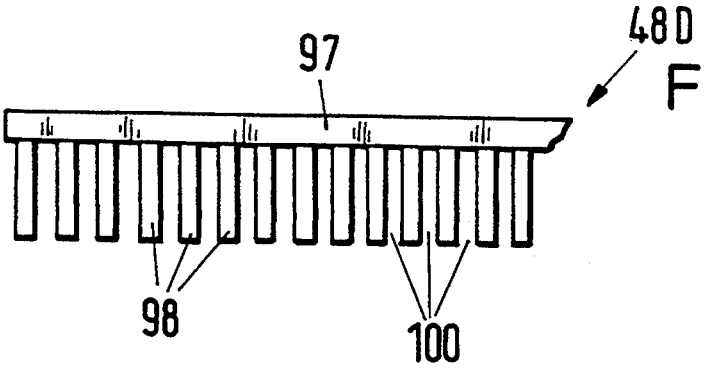

FIG. 6 shows in FIGS. 6A, 6B and 6C the guide legs of three further embodiments of the guide plate 48B, 48C and 48D. The guide leg of plate 48B consists of fingers 92 with interposed longitudinal gaps 94. As the effect is similar to that of the embodiment in accordance with FIG. 5, the respective description shall not be repeated. The embodiment 48C looks similar. However, the guide leg is provided with grooves 96 instead of gaps. The effect in this case is similar to that of alleys 70 (FIG. 4A).

The embodiment 48D in accordance with FIG. 6C consists of a rod 97 and pins 98 projecting therefrom with interposed gaps 100. The pins 98 serve to guide the fleece between the pins 98 and a means, such as a swift, for conveying the fleece along a curved path to subject the fleece to centrifugal force. The gaps 100 serve to pass the impurities thrown off from a conveyed fleece into a suitable opening leading, for example, to a suction device.

Figure 7:
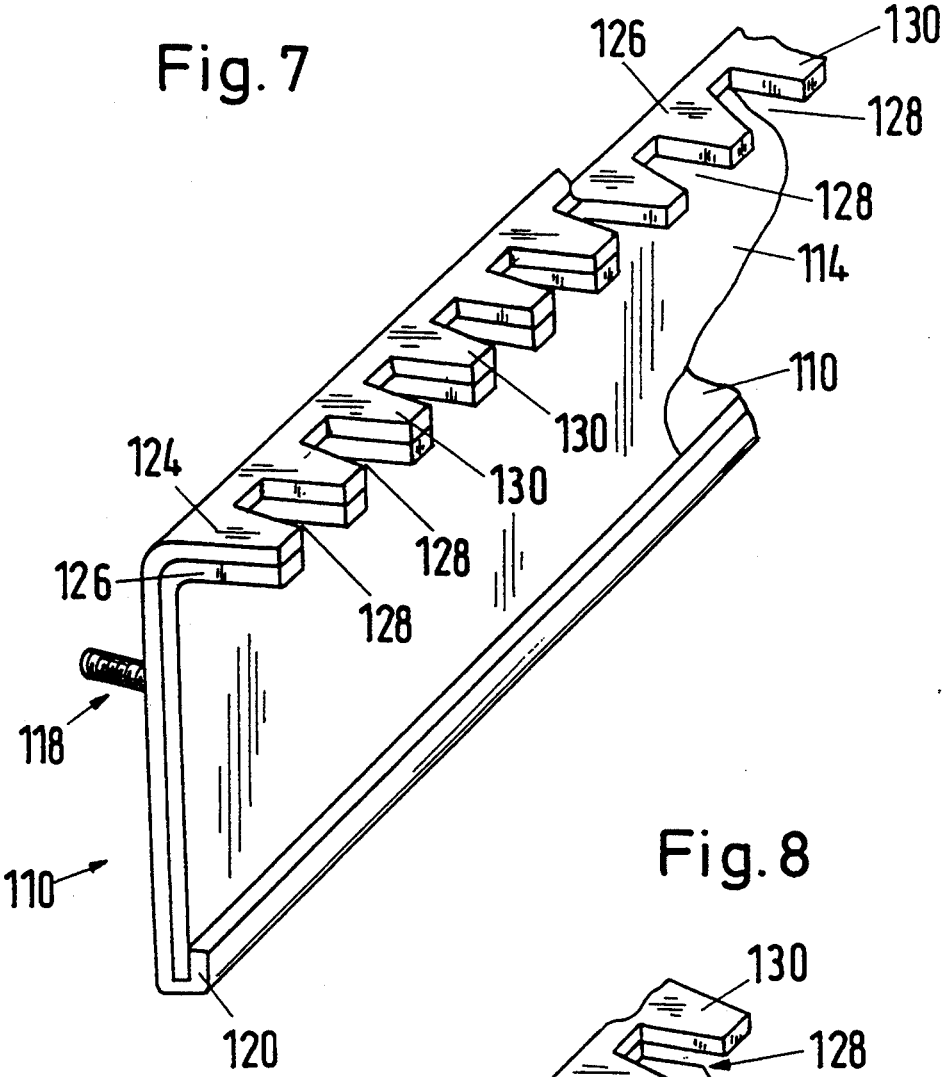
Figure 8:
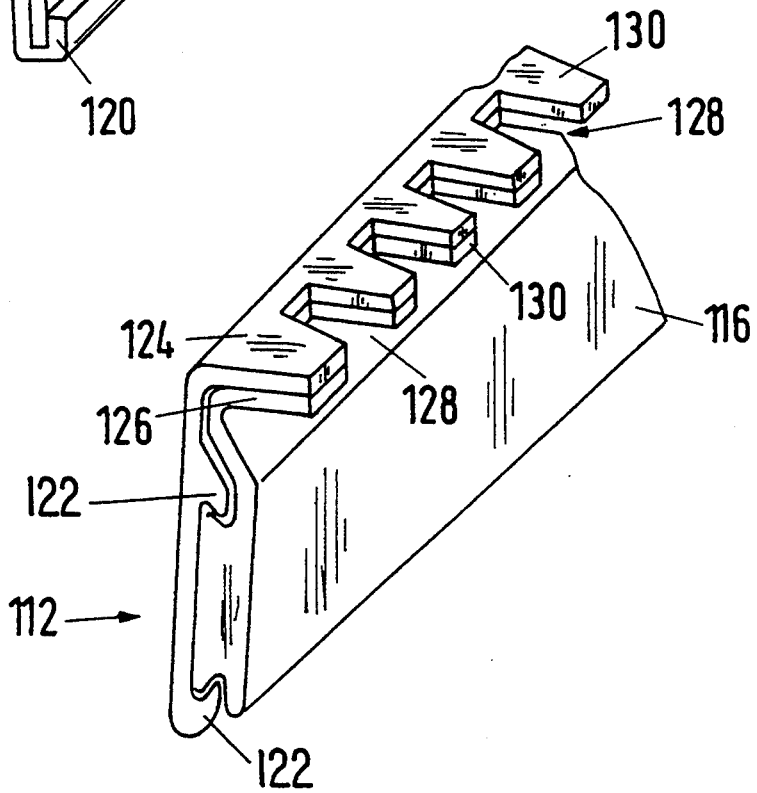

The width of the gaps should be adapted to the fiber material, which is somewhat problematic if the plate has to be exchanged for this purpose. FIGS. 7 and 8 therefore show two adjustable embodiments. In both cases, the guide element is arranged bipartite with a carrier element 110 (FIG. 7), 112 (FIG. 8) and a movable part 114 (FIG. 7), 116 (FIG. 8). The carrier element 110, 112 is provided with attachment means (e.g. screws 118, FIG. 7), with which the guide element can be attached to an adjacent element (e.g. element 43, FIG. 2 or 53, FIG. 3). Every carrier element 110, 112 is also provided with a projection 120 (FIG. 7) or with projections 122 (FIG. 8) so as to form a guiding means for the respective movable part 114, 116.

Both the carrier element 110, 112 as well as the movable element 114, 116 comprises a projecting guide plate 124, 126. Every guide plate is provided with notches 128 and interposed teeth 130. These notches and teeth are substantially similar to notches 88 and teeth 90 (FIG. 5).

The effective width of notches 128 can only be changed in that the displaceable element 114, 116 is displaced with respect to the respective carrier element 110, 112. The notches 128 can be "closed" when the teeth 130 of the displaceable element 114, 116 are in alignment with the notches 128 of carrier element 110, 112, whereby, in this event, the notches 128 of carrier element 110, 112 still represent "grooves" with respect to the guide surfaces of teeth 130 of the carrier element.

The application of these principles in the card is now explained in greater detail by reference to FIGS. 9 and 10. Parts which have already been explained in connection with FIG. 4 and which remain unchanged in FIG. 9 are provided in both Figures with the same reference numerals and shall not be explained again in connection with FIG. 9.

Figure 9:
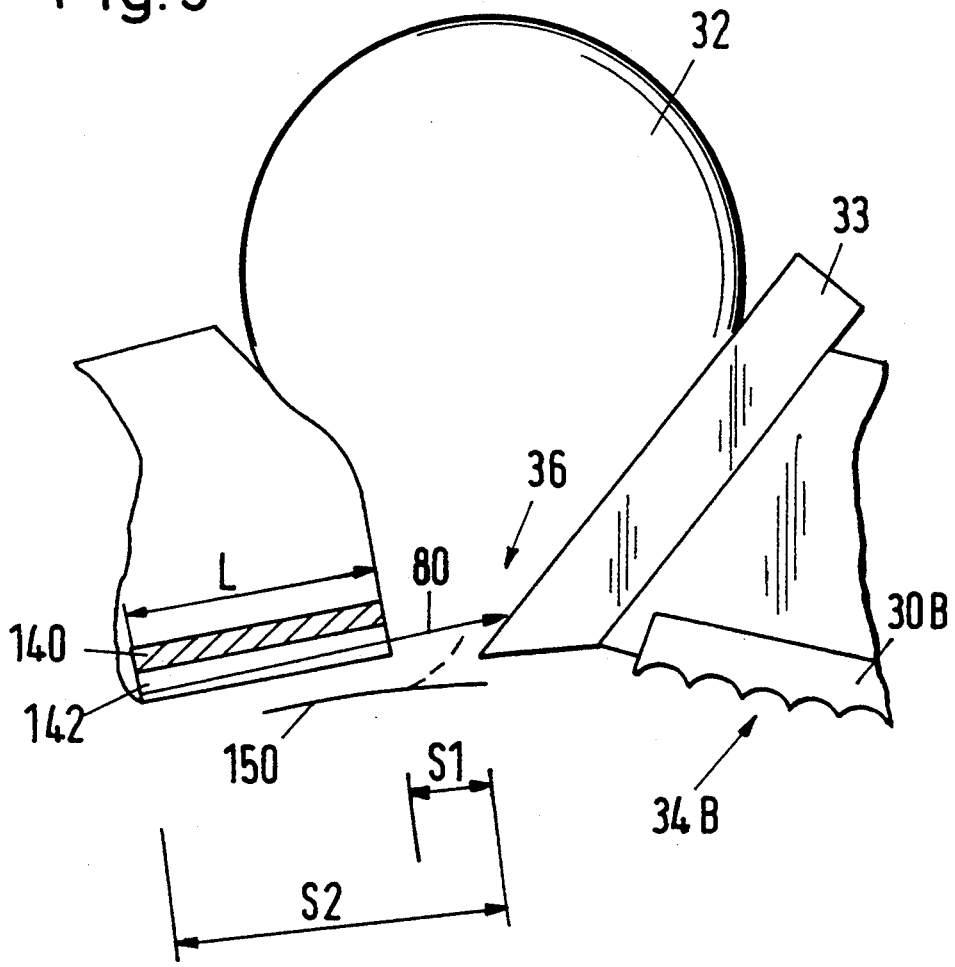
FIG. 9 shows a schematic illustration of a changed embodiment for the card.
Figure 10:
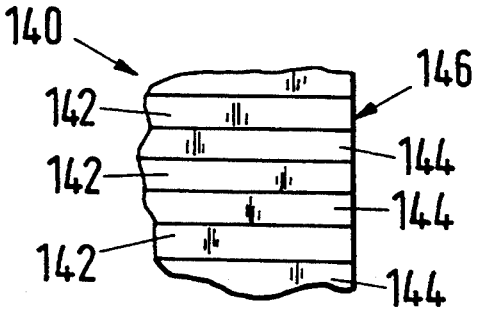
FIG. 10 shows a detail of the embodiment in accordance with FIG. 9.

Element 30A of the embodiment in accordance with the state of the art (FIG. 4) is replaced in FIG. 9 by an element 140 with grooves or flutes 142. Which extend in the direction of movement of the fiber fleece (like the "alleys" 70 of the embodiment in accordance with FIGS. 4, 4A). FIG. 10 is equivalent to the view of FIG. 4A for the embodiment in accordance with FIG. 9. In FIG. 10, the radially inwardly directed guiding surfaces of element 140 are indicated by reference numeral 144.

One effect of the element 140 is an effective increase of the width of opening 36, provided that the particles involved are fiber fragments or short fibers which are able to penetrate a groove 142 fully. The width of opening 36 between the front edge 146 (FIG. 10) of element 140 and knife 33 is indicated in FIG. 9 by reference numeral S1. This width "applies", for example, to a fiber 150 which is held in the fiber fleece on the drum (not shown in FIG. 9). This is even the case when the "head" (i.e., the front end) of the fiber 150 extends radially outwardly, as is indicated in FIG. 9 in the broken line.

For a dirt particle (or a fiber which is not held in the fleece), however, a "width" S2 "applies" which also encompasses the length L of groves 142. This only applies because the knife 33 extends radially inwardly through the mantle surface which comprises the guiding surfaces 144 of element 140. It is therefore possible to select the width S1 narrower and nevertheless achieve a predefined impurity separation effect.

FIG. 11 schematically shows a grid according to European patent application No. 91 116 934.0 (filed on Oct. 4, 1991). Grid rod modules M are carried by a frame 157 and distributed along the circumference of an opening roller 150. The modules M are each allocated to a fiber feed and/or opening and/or cleaning function (and they are adapted to their respective function). The modules can be used in a changeable order. Every module M is to be understood as being a casing element within the terms of the present invention.

The whole contents of EP 91 116 934.0 are incorporated by reference in this application.

FIG. 12 schematically shows a signal (random) grid rod module Mx from the arrangement in accordance with FIG. 11. This module Mx has a separating edge 152, a guide surface 154 and an edge 156 which limits a separating opening 158 (FIG. 11) between this module Mx and the next adjacent module or the next adjacent casing element (as seen in the direction of flow).

Module Mx is provided with guide grooves 160 which form "recesses" in the guide surface and open out into the separating opening, i.e., they extend up to edge 156.

As is shown in the example in accordance with FIGS. 11 and 12, this invention can be favourably integrated in applications which are designed for influencing the separating process in its entirety, either by radial or tangential displacement or by rotation of the casing element. In such cases, it is also always desirable to improve the selectivity of the separating process so that "batch fibers" (depending on the requirements) are conveyed further and undesirable material is separated.

FIG. 13 shows diagrammatically the guide path FB of conveyed material with a radius of curvature R. Path FB is outwardly limited at a certain position S by a casing element V of length "L". A particle which is to be separated "tries" to follow the tangential "separating path" AB, which is enabled by the present invention.

This leads to depth "t" of the groove to be formed in casing element V, namely from the ratio element length:radius of curvature (L:R). Theoretically, the groove could be provided with a depth which increases over the length of the groove. In practice, however, a groove (flute) will usually be formed which has a constant depth over its length, whereby this depth should be selected slightly larger than the "minimum" depth t (FIG. 13).

The width of every "alley" 70 is substantially produced in the embodiment in accordance with FIG. 4 by the successive combination of standardized wire elements 64. This width, however, can also be determined by providing a distance between the wire elements or (in other arrangements) the arrangement of the guide grooves or guide gaps. As is shown in FIG. 5, the width of the guide groove of guide gap can change over the length of the groove or gap (increase towards the separating opening).

The following typical values for various dimensions of the arrangement are stated as examples:

The length of the grooves or gaps is typically 5 to 50 mm.

The width S1 of opening 36 is typically 5 to 25 mm.

The distance of the guiding surfaces from the clothing is:

0.5 to 2 mm on a cleaning roller;
0.2 to 1 mm on a licker-in;
0.2 to 0.7 mm on the swift.

The width of the grooves or gaps on the separating opening is typically:

3 to 20 mm on a cleaning roller;
1 to 8 mm on the licker-in;
0.3 to 2 mm on the swift.

The invention thus provides a relatively simple construction for the separation of impurities and trash from a fiber fleece travelling on a roller or other means for conveying the fleece in a curved path. In this respect, the invention takes advantage of the centrifugal force on the travelling fleece in order to separate the impurities from the fleece into the separating opening.

We claim:

1. In combination means for conveying a fiber fleece along a curved path to subject the fleece to centrifugal force; and at least two casing elements spaced from said means along said curved path to define an opening therebetween with an upstream one of said casing elements relative to said curved path having a guide surface for a fleece on said means, an edge adjacent said opening, and a plurality of parallel guide grooves in said guide surface extending to said edge for passage of impurities thrown off from a conveyed fiber fleece under said centrifugal force into said opening.

2. The combination as set forth in claim 1 which further comprises means on a side of said opening opposite said one casing element and defining a surface for deflecting impurities thrown into said opening in a direction away from said curved path.

3. The combination as set forth in claim 1 wherein said means for conveying a fleece is one of a licker-in, a cleaning roller and an opening roller.

4. In combination means for conveying a fiber fleece along a curved path to subject the fleece to centrifugal force;

at least one casing element spaced from said means along said curved path and extending across said path; and a guide element mounted on said casing, said guide element including a leg extending from said casing in facing relation to said means to guide the fiber fleece on said means, said leg having gaps in a free edge thereof to define passages for impurities thrown off from the conveyed fleece.

5. The combination as set forth in claim 4 which further comprises a second means opposite said casing element and defining a surface for deflecting impurities thrown from said guide element lag in a direction away from said curved path.

6. The combination as set forth in claim 4 wherein said means is a licker-in of a card.

7. The combination as set forth in claim 4 wherein said means is one of a cleaning roller and an opening roller.

8. The combination as set forth in claim 4 wherein said casing element is adjustable radially of said means.

9. The combination as set forth in claim 4 which further comprises a second casing element spaced from said one casing element to define an opening therebetween for receiving impurities conveyed from said guide element on said one casing element.

10. In combination means for conveying a fiber fleece along a curved path to subject the fleece to a centrifugal force;

at least one casing element spaced from said means along said curved path to guide a fleece therebetween; and a guide element mounted on said casing element and having a carrier element including a plurality of teeth extending in facing relation to said means to guide the fiber fleece therebetween and notches between said teeth for passage of impurities thrown from the conveyed fleece, said guide element further having a part movably mounted in said carrier element, said part including a plurality of teeth and notches therebetween in alignment with said teeth and notches of said carrier element.

11. The combination as set forth in claim 10 wherein said means is one of a rotatable swift, a licker-in roller, a cleaning roller and an opening roller.

12. The combination as set forth in claim 11 wherein said gap is of a width transversely of said path less than the length of a fiber extending from the conveyed fleece.

13. In combination means for conveying a fiber fleece along a curved path to subject the fleece to a centrifugal force;

at least one casing element spaced from said means along said curved path to guide a fleece therebetween; and a guide element mounted on said casing element and having a guide leg extending from said casing element in facing relation to said means to guide a fleece therebetween, said leg having a plurality of parallel grooves facing said means to define passages for impurities thrown off from the conveyed fleece.

14. In combination means for conveying a fiber fleece along a curved path to subject the fleece to a centrifugal force;

at least one casing element spaced from said means along said curved path to guide a fleece therebetween; and a guide element mounted on said casing element and having a plurality of parallel pins projecting therefrom to guide a fleece between said pins and said means, said pins being spaced apart to define gaps for impurities thrown off from the conveyed fleece.

15. In combination means for conveying a fiber fleece along a curved path to subject the fleece to centrifugal force;

a plurality of casing elements spaced from said means along said curved path, at least two casing elements being spaced apart to define an opening therebetween; and a guide plate mounted on and extending from an upstream one of said two casing elements relative to said curved path, said plate having a row of teeth in an edge thereof and gaps separating said teeth, each gap being wider than a tooth and facing said means to direct impurities thrown off from the conveyed fleece under said centrifugal force into said opening.

16. The combination as set forth in claim 15 wherein said gap is of a width transversely of said path less than the length of a fiber extending from the conveyed fleece.

17. The combination as set forth in claim 15 which further comprises a carrier element movably mounting said guide plate therein, said carrier element having a row of spaced apart teeth aligned with said teeth of said guide plate.

18. The combination as set forth in claim 15 which further comprises a second means on a side of said opening opposite said one casing element and defining a surface for deflecting impurities thrown into said opening in a direction away from said curved path.

19. The combination as set forth in claim 15 wherein said means is one of a licker-in of a card, a cleaning roller and an opening roller.

* * * * *

UNITED STATES PATENT AND TRADEMARK OFFICE

CERTIFICATE OF CORRECTION

PATENT NO. : 5,448,800

DATED : Sep. 12, 1995

INVENTOR(S) : Jurg Faas and Robert Demuth

It is certified that error appears in the above-indentified patent and that said Letters Patent is hereby corrected as shown below:

Column 2, line 17 change "form" to -from-

Column 8, line 19 change "lag" to -leg-

Signed and Sealed this

Fifth Day of December, 1995

Bruce Lehman

*Attest:*

BRUCE LEHMAN

*Attesting Officer*

*Commissioner of Patents and Trademarks*